US006868897B2

(12) United States Patent
Nash et al.

(10) Patent No.: US 6,868,897 B2
(45) **Date of Patent: *Mar. 22, 2005**

(54) DUAL-DENSITY HEADER FIN FOR UNIT-CELL PLATE-FIN HEAT EXCHANGER

(75) Inventors: James S. Nash, West Newbury, MA (US); Alexander Haplau-Colan, Hampton, NH (US)

(73) Assignee: Ingersoll-Rand Energy Systems Corporation, Portsmouth, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/208,393

(22) Filed: Jul. 30, 2002

(65) Prior Publication Data

US 2002/0185265 A1 Dec. 12, 2002

Related U.S. Application Data

(63) Continuation of application No. 09/790,464, filed on Feb. 22, 2001, now Pat. No. 6,460,613, which is a continuation-in-part of application No. 09/668,358, filed on Sep. 25, 2000, now abandoned, which is a continuation-in-part of application No. 09/409,641, filed on Oct. 1, 1999, now Pat. No. 6,305,079, which is a continuation of application No. 09/239,647, filed on Jan. 29, 1999, now Pat. No. 5,983,992, which is a continuation of application No. 08/792,261, filed on Jan. 31, 1997, now abandoned.

(60) Provisional application No. 60/010,998, filed on Feb. 1, 1996.

(51) Int. Cl.[7] ..... F28F 13/08; F28F 3/06

(52) U.S. Cl. ..... 165/82; 165/146; 165/153; 165/166; 165/167; 165/170

(58) Field of Search ..... 165/81, 82, 146, 165/153, 166, 167, 170, 174, 175, 152, 906

(56) References Cited

U.S. PATENT DOCUMENTS

| | | | | |
|---|---|---|---|---|
| 3,166,122 A | | 1/1965 | Hryniszak | |
| 3,322,189 A | | 5/1967 | Topouzian | |
| 3,380,517 A | | 4/1968 | Butt | |
| 3,669,186 A | | 6/1972 | Schauls | |
| 3,860,065 A | | 1/1975 | Schauls | |
| 4,049,051 A | * | 9/1977 | Parker | 165/166 |
| 4,073,340 A | | 2/1978 | Parker | |
| 4,291,754 A | | 9/1981 | Morse et al. | |
| 4,352,393 A | | 10/1982 | Vidal-Meza | |
| 5,983,992 A | | 11/1999 | Child et al. | |
| 6,032,730 A | | 3/2000 | Akita et al. | |
| 6,460,613 B2 | * | 10/2002 | Nash et al. | 165/153 |

* cited by examiner

*Primary Examiner*—Leonard R. Leo
(74) *Attorney, Agent, or Firm*—Michael Best & Friedrich, LLP

(57) ABSTRACT

A heat exchange cell for a recuperator includes top and bottom plates sandwiching a matrix finned member and a pair of header finned members. The top and bottom plates each include a pair of manifold openings, and the header finned members each include a curved free edge following the curvature of an associated manifold opening. The header finned member includes a high fin density portion along the free edge and a low fin density portion communicating with the high fin density portion. The dual fin density header finned member thus provides increased structural strength along the free edge and provides a low pressure drop through the low fin density portion.

18 Claims, 4 Drawing Sheets

DUAL-DENSITY HEADER FIN FOR UNIT-CELL PLATE-FIN HEAT EXCHANGER

This application is a continuation of U.S. patent application Ser. No. 09/790,464 filed Feb. 22, 2001 now U.S. Pat. No. 6,460,613, which is a continuation-in-part of U.S. patent application Ser. No. 09/668,358 filed Sep. 25, 2000 now abandoned, which is a continuation-in-part of U.S. application Ser. No. 09/409,641 filed Oct. 1, 1999 now U.S. Pat. No. 6,305,079, which is a continuation of U.S. application Ser. No. 09/239,647 filed Jan. 29, 1999 now U.S. Pat. No. 5,983,992, which is a continuation of U.S. application Ser. No. 08/792,261 filed Jan. 31, 1997 now abandoned, which claims the benefit of U.S. Provisional Application No. 60/010,998 filed Feb. 1, 1996.

FIELD OF THE INVENTION

The invention relates to recuperators primarily for use in gas turbine engines, and more particularly to a fin construction for the header portions of such recuperators.

BACKGROUND

Plate-fin heat exchangers or recuperators have been used to pre-heat combustion-inlet air in a microturbine. A typical configuration for a heat exchanger includes a stacked array of cells of plate-fins, each cell including top and bottom plates, an internal finned member or matrix fin disposed between the plates, two external finned members on the outside surfaces of the cell, an inlet header finned member, and an outlet header finned member. The header finned members and matrix finned members are typically brazed or otherwise metallurgically bonded to the top and bottom plates. The inlet and outlet header finned members are also commonly referred to as crossflow headers because they are positioned at the inlet and outlet ends of the cell and because the flow of fluid through them is at an angle with respect to the flow of fluid through the matrix finned member.

In some applications, the pressure in the headers can reach high levels, which forces the top and bottom plates away from each other and creates tension in the header finned members. The header finned members thus perform a structural function as they tie the top and bottom plates together and resist deformation of the header portion of the cell that may be caused by the pressure in the cell. Accordingly, the header finned members must be sufficiently strong to resist such tensile deformation.

While the header finned members must perform the above-described structural function, the header finned members must also be constructed to not unduly restrict flow of air. The density of the fins must be selected to minimize the pressure drop through the headers. A balance must be found between maximizing header fin density to provide structural strength to the header, and minimizing header fin density to lower the pressure drop across the header.

One known method for balancing the structural and performance requirements of a header is to make the header wide enough to provide sufficient fin density to meet structural requirements while allowing enough flow area to meet pressure loss or performance requirements. To minimize the cost of tooling, standard header sizes have been implemented to cover a range of applications. Problems arise with these standard head sizes when volumetric constraints, non-typical operating conditions, or unusual performance specifications are required for a particular application.

SUMMARY

The present invention seeks to balance structural and performance requirements in crossflow headers by presenting a graded approach to fin density. In this way, the present invention provides a higher density of fins in regions with the greatest structural demand while minimizing fin density where structural demands are lighter to minimize pressure loss.

More specifically, the present invention provides a recuperator or heat exchanger cell including top and bottom plates each including a manifold opening. The top and bottom plates are positioned relative to one another to align the respective manifold openings. The cell also includes a matrix finned member disposed between the top and bottom plates. The matrix finned member and the top and bottom plates together define matrix channels for the flow of fluid between the top and bottom plates in a first direction.

Also disposed between the top and bottom plates is at least one header finned member. The header finned member, together with the top and bottom plates, defines header channels for the flow of fluid between the top and bottom plates in a second direction at an angle to the first direction, and the header channels communicate between the matrix channels and the manifold openings. The header finned member includes a low fin density portion and a high fin density portion positioned between the low fin density portion and the manifold openings.

Other features and advantages of the invention will become apparent to those skilled in the art upon review of the following detailed description, claims, and drawings.

Figure 1:
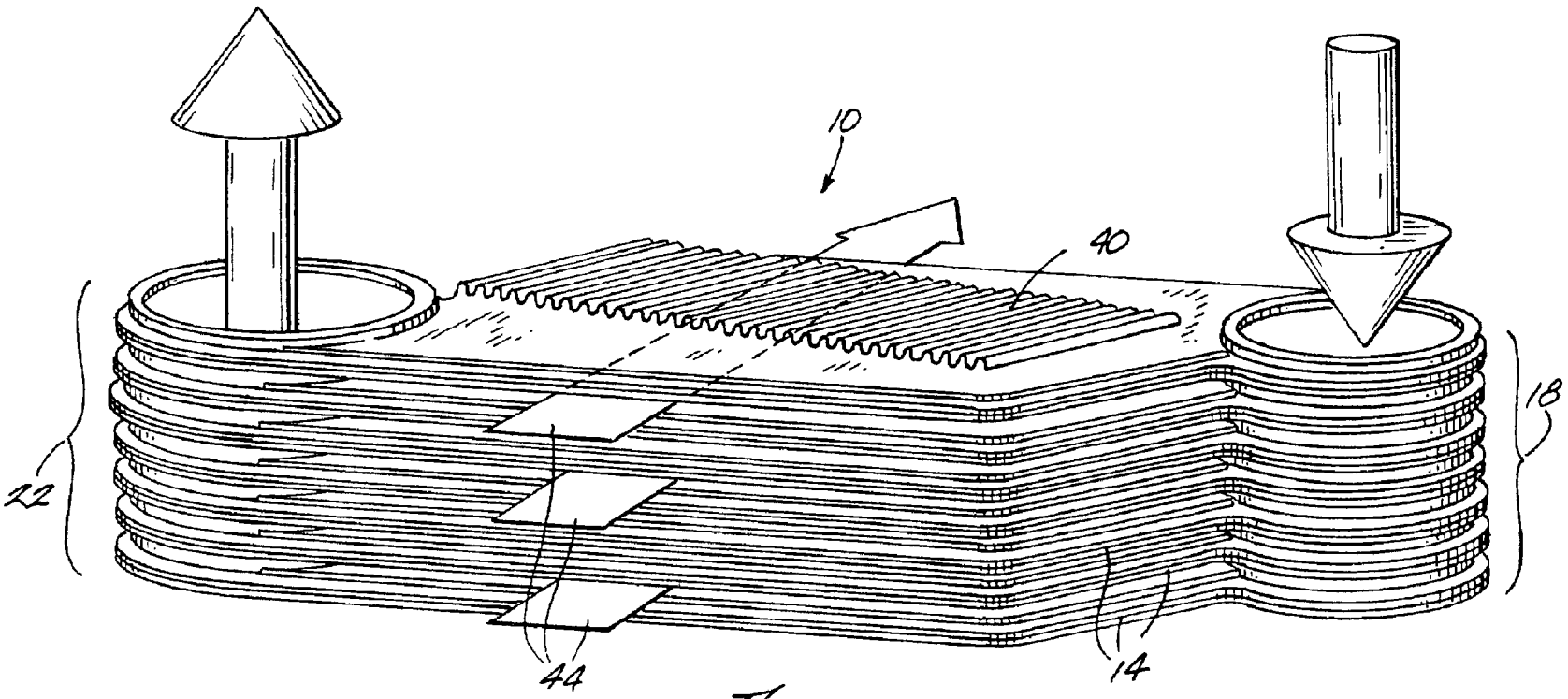
FIG. 1 is a perspective view of the core of a recuperator.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

For the sake of brevity, not all aspects of plate fin heat exchanger and microturbine combustor technology are discussed herein. For additional information and discussion of the technology, reference is made to U.S. patent application Ser. No. 09/668,358 filed Sep. 25, 2000, Ser. No. 09/409,641 filed Oct. 1, 1999, Ser. No. 09/239,647 filed Jan. 29, 1999 (now U.S. Pat. No. 5,983,992), and Ser. No. 08/792,261 filed Jan. 13, 1997, and U.S. Provisional Patent Application No.

60/010,998 filed Feb. 1, 1996. The entire contents of the just-listed patent applications are incorporated herein by reference.

Figure 2:
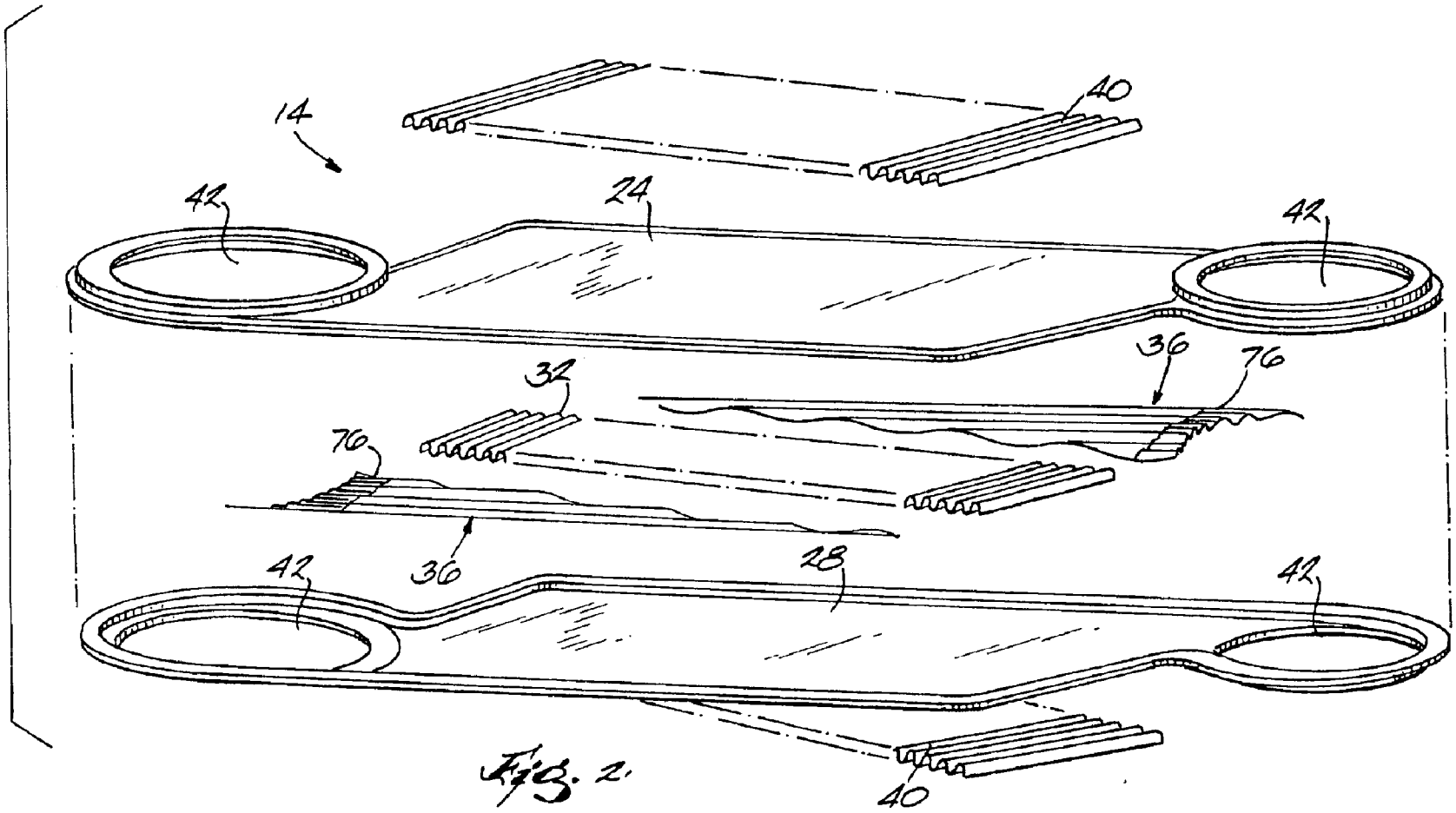
FIG. 2 is an exploded view of one cell of the core illustrated in FIG. 1.
Figure 3:
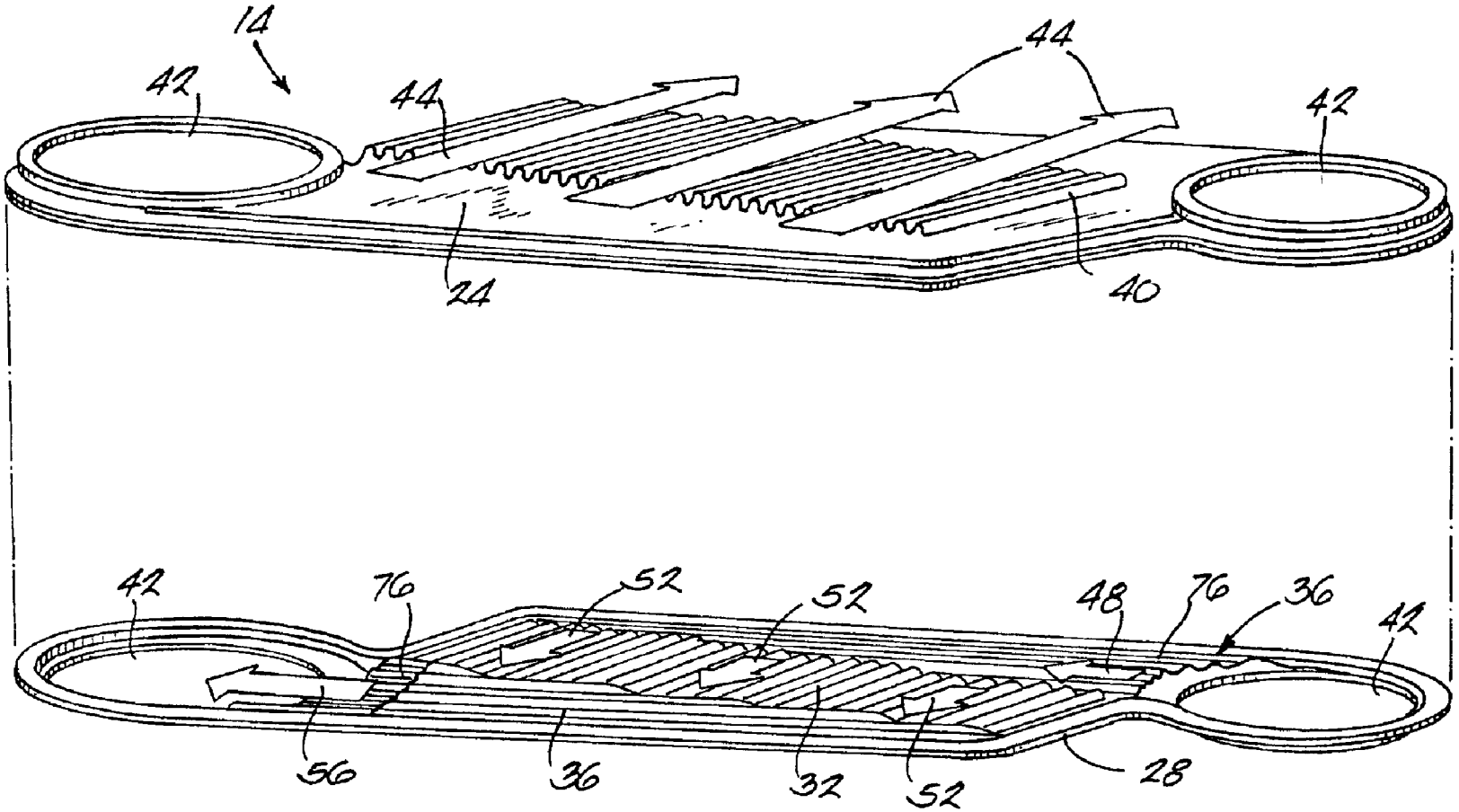
FIG. 3 is a partially exploded view of the cell illustrated in FIG. 2.

FIG. 1 illustrates a core 10 for a recuperator used in a microturbine. The core 10 includes a plurality of stacked plate-fin cells 14 defining an inlet manifold 18 and an outlet manifold 22. As seen in FIGS. 2 and 3, each cell 14 includes top and bottom plates 24, 28, an internal or matrix finned member 32, inlet and outlet header finned members 36, and external finned members 40. The top and bottom plates 24, 28 include manifold openings 42 that align to define the manifolds 18, 22.

The matrix finned member 32 and header finned members 36 are sandwiched between and metallurgically bonded (e.g., by brazing) to the inwardly-facing surfaces of the top and bottom plates 24, 28. The external finned members 40 are metallurgically bonded to the outwardly-facing surfaces of the top and bottom plates 24, 28. The cells 14 are assembled and are bonded to each other as described in the above-referenced patents and patent applications. The header finned members 36 and the plates 24, 28 define header channels, and the matrix finned member 32 and the plates 24, 28 define matrix channels for the flow of compressed air through the cell 14 between the manifolds 18, 22.

Thus, a flow path 44 (FIGS. 1 and 3) between the cells 14 is provided for the flow of hot products of combustion, and a flow path 48, 52, 56 (FIG. 3) is provided within the cell 14 for compressed air being supplied to the combustor. The header portions of the cell 14 are also commonly referred to as "crossflow headers" because the flow of fluid 48, 56 through the header channels is at an angle with respect to the flow of fluid 52 through the matrix channels of the cell 14. The core 10 acts as a counterflow heat exchanger as hot products of combustion flow in one direction 44 and compressed air flows in the opposite direction 52 through the matrix channels. This has the effect of preheating the compressed air and increasing the efficiency of the microturbine. Most of the heat transfer occurs in the counterflow portion of the core 10.

Figure 4:
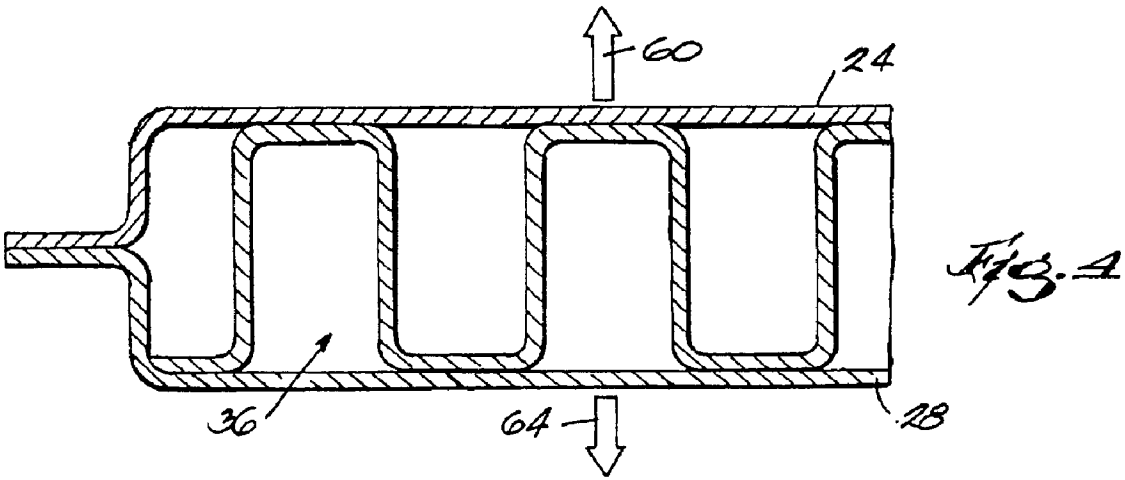
FIG. 4 is a cross-section view of a header of one cell of the core illustrated in FIG. 1.

FIG. 4 illustrates a few fins of one of the header finned members 36, along with portions of the top and bottom plates 24, 28. The compressed air flowing through the header portions of the cells 14 creates high pressure in the header portions, and tends to force the top and bottom plates 24, 28 away from each other, as indicated by reference numerals 60, 64. This pressure creates tension in the vertical portions of the header finned members 36, and the vertical portions resist the pressure forces in the header portions and resist separation of the top and bottom plates 24, 28.

Figure 5:
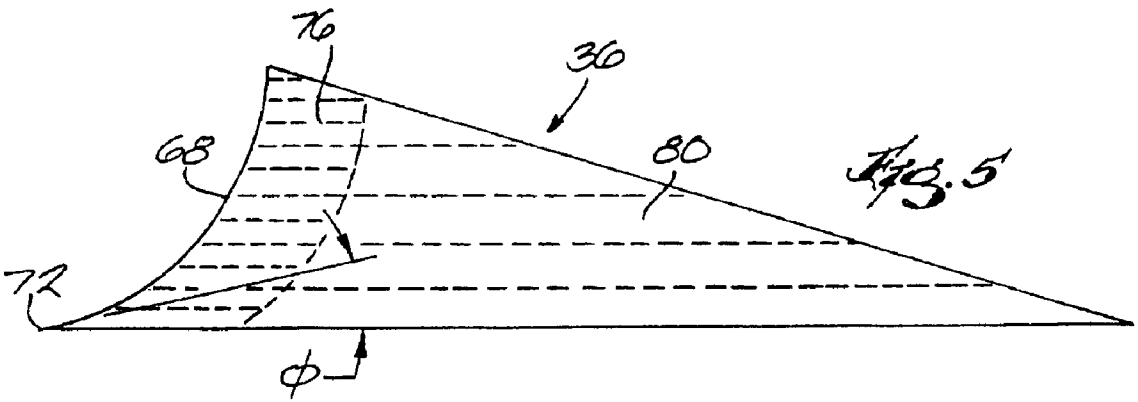
FIG. 5 is a top plan view of the dual density header finned member.

Turning to FIG. 5, a free edge portion 68 of the header finned members 36 is positioned along the manifold openings of the cell 10 and is curved to mirror the shape of the manifold openings. The more pronounced the curvature of the header finned member's free edge 68, the greater the spacing between the header fins along the edge 68. The free edge 68 includes a sharply pointed or acutely angled portion 72 where the effective header fin density is lowest.

Elsewhere in the header portion, the theoretical nominal pressure capacity for the fins (i.e., the pressure at which the header finned member will theoretically fail) is proportionate to the fin density multiplied by the thickness of the fin material. However, the theoretical pressure capacity along the curved free edge 68 of the header finned member 36 equals the nominal pressure capacity multiplied by the sine of the angle $\phi$ of a line tangent to the free edge 68. The sharply pointed portion 72 is therefore the portion of the header most likely to fail under high pressure conditions because the angle $\phi$ is smallest at the sharply pointed portion 72.

To account for the change in effective fin density along the free edges 68 of the header finned members 36, a high fin density portion 76 is provided to withstand the highest pressure conditions expected to be encountered. The high density portions 76 extend the entire width of the header finned members 36 to equalize the flow of fluid across the header finned members 36. To minimize the pressure drop across the header portions, low fin density portions 80 are provided in areas of the header finned members 36 that are subject to less stress due to pressure. Alternatively, the thickness of the material used to fabricate the header finned members 36 may be increased in the high fin density portion 76, while maintaining the nominal fin density constant throughout the header finned member 36.

In a preferred embodiment of the invention, the angle $\phi$ at the sharply pointed portion 72 is between about 20–35°. Thus, assuming the high and low density portions 76, 80 are constructed of the same material having the same thickness, the low density portion 80 may theoretically have a fin density of about 34–58% that of the high density portion 76. However, due to certain bending stresses present at the plate-fin interface, it is preferred to make the density of the low density portion 80 about 50–70% of the density of the high density portion 76.

Alternatively, the fin density may be maintained substantially the same in the high and low density portions 76, 80, and the material thickness in the low density portion 80 can be reduced to 34–58%, or preferably 50–70%, of the material thickness of the high density portion 76. As another alternative, the width of the header finned members 36 can be reduced and the material thickened in the high density portion 76 to create a potential reduction in the cost of manufacturing the header finned members 36.

An example of one dual-density header construction includes the high and low density portions both being constructed of 0.005 inch thick high temperature material (e.g., stainless steel or Iconel 625 nickel alloy). The minimum value of $\phi$ is about 20°. The high density portion may have a fin density of 15 fins-per-inch and the low density portion may have a fin density of 5 fins-per-inch.

What is claimed is:

1. A heat exchange cell comprising:

a matrix portion;

a header portion in fluid communication with the matrix portion;

a matrix finned member within the matrix portion of the cell;

a header finned member within the header portion of the cell and having a plurality of fins in a first portion and a second portion, the first and second portions sharing a common boundary, the first portion having at least one fin and less than about seventy percent of the fins at the boundary as the second portion; and a manifold having at least one arcuate edge, wherein an end of the second portion of the header finned member extends along the arcuate edge.

2. The cell of claim 1, wherein the first portion has about 50–70% the number of fins of the second portion at the boundary.

3. The cell of claim 1, wherein the second portion has at least twice the number of fins as the first portion at the boundary.

4. The cell of claim 1, wherein the end of the second portion extending along the arcuate edge of the manifold at least partially defines an acutely-angled portion of the cell.

5. The cell of claim 1, wherein the cell is adapted to exchange heat from a hot fluid outside of the cell to a cool fluid within the cell, wherein the header portion of the cell conducts a flow of the cool fluid into the matrix portion, and wherein the majority of heat transfer between the hot fluid and cool fluid occurs within the matrix portion.

6. The cell of claim 1, wherein the cell further comprises an upper plate and a lower plate, and wherein the fins of the first and second portions are metallurgically bonded to the upper and lower plates.

7. A heat exchanger cell comprising:

top and bottom plates each including a manifold opening, the top and bottom plates being positioned relative to one another to align their respective manifold openings in stacked relation with each other;

a matrix finned member disposed between the top and bottom plates and at least partially defining matrix channels for the flow of fluid between the top and bottom plates in a first direction; and a header finned member in fluid communication between the manifold opening and the matrix finned member to deliver the flow of fluid therebetween, the header finned member including a plurality of fins disposed within a first portion and a second portion, the first and second portions sharing a boundary, the first portion having a first quantity of fins along the boundary and the second portion having a second quantity of fins along the boundary, the first quantity being less than about seventy percent of the second quantity and the first quantity including at least one fin;

wherein the second portion includes an arcuate free edge at least partially defining an acutely-angled portion of the cell, and wherein the cell includes a manifold having at least one arcuate edge at least partially defined by the arcuate free edge.

8. The cell of claim 7, wherein the first portion has about 50–70% the number of fins of the second portion along the boundary.

9. The cell of claim 7, wherein the second portion has at least twice the number of fins as the first portion along the boundary.

10. The cell of claim 7, wherein the fins of the first and second portions are metallurgically bonded to the top and bottom plates.

11. A heat exchange cell comprising:

first and second plates, each plate having an inlet aperture and an outlet aperture, the upper and lower plates positioned such that the inlet apertures are aligned to at least partially define an inlet manifold and the outlet apertures are aligned with one another to at least partially define an outlet manifold;

a first header finned member metallurgically bonded to the first and second plates and having a first portion and a second portion sharing a boundary, the first portion disposed adjacent the inlet aperture and having a first quantity of fins at the boundary, the second portion having a second quantity of fins at the boundary, the second fin quantity being less than about seventy percent of the first quantity, the second fin quantity including at least one fin; and a second header finned member metallurgically bonded to the first and second plates and having a first portion and a second portion sharing a boundary, the first portion disposed adjacent the outlet aperture and having a first quantity of fins at the boundary, the second portion having a second quantity of fins at the boundary, the second fin quantity being less than about seventy percent of the first quantity.

12. The cell of claim 11, wherein the second portions of the first and second header finned members have about 50–70% the number of fins of the first portions of the first and second header finned members along their respective boundaries.

13. The cell of claim 11, wherein the first portions of the first and second header finned members have at least twice the number of fins as the second portions of the first and second header finned members along their respective boundaries.

14. The cell of claim 11, wherein the first portion of the first and second header finned members each include an arcuate free edge at least partially defining an acutely-angled portion of the cell.

15. The cell of claim 14, wherein each of the manifolds includes at least one arcuate edge at least partially defined by the arcuate free edges.

16. A method for accommodating a pressure load within a heat exchange cell including upper and lower plates defining a manifold having an arcuate edge, the method comprising the steps of:

attaching a plurality of fins to the plates to define a header region, the header region having a first portion and a second portion that meet along a common boundary, the second portion adjacent the arcuate edge;

introducing a pressurized fluid into the cell;

biasing the plates away from each other under the influence of the pressurized fluid and thereby applying a tension force in the fins;

increasing the number of fins in the second portion relative to the first portion such that the second portion includes at least six more fins then the first portion to reduce the stress in the second portion.

17. The method of claim 16, wherein the fins include a first finned portion spaced from the arcuate edge, and a second finned portion extending along the arcuate edge and communicating between the manifold and the first finned portion, wherein the increasing step includes increasing the number of fins in the second finned portion, the method further comprising reducing the number of fins in the first finned portion.

18. The method of claim 17, further comprising aligning the fins of the respective first and second finned portions parallel to each other.

* * * * *